US007599471B2

(12) United States Patent
Safai et al.

(10) Patent No.: US 7,599,471 B2
(45) Date of Patent: Oct. 6, 2009

(54) METHOD AND APPARATUS FOR ROTATING AN ANODE IN AN X-RAY SYSTEM

(75) Inventors: Morteza Safai, Seattle, WA (US); Gary E. Georgeson, Federal way, WA (US); William Talion Edwards, Foristell, MO (US)

(73) Assignee: The Boeing Company, Chicago, IL (US)

( * ) Notice: Subject to any disclaimer, the term of this patent is extended or adjusted under 35 U.S.C. 154(b) by 41 days.

(21) Appl. No.: 11/923,031

(22) Filed: Oct. 24, 2007

(65) Prior Publication Data

US 2009/0110147 A1 Apr. 30, 2009

(51) Int. Cl.
*H01J 35/02* (2006.01)
*H01J 35/24* (2006.01)

(52) U.S. Cl. ..... 378/125; 378/131; 378/144; 378/146

(58) Field of Classification Search ..... 378/4, 378/15, 21, 37, 124–126, 131, 140, 144, 378/146, 147, 143, 86–90
See application file for complete search history.

(56) References Cited

U.S. PATENT DOCUMENTS

| | | | | |
|---|---|---|---|---|
| 1,192,706 | A * | 7/1916 | Thomson | 378/131 |
| 2,825,817 | A * | 3/1958 | North | 378/146 |
| 4,107,563 | A * | 8/1978 | Oddell | 378/126 |
| 4,179,100 | A * | 12/1979 | Sashin et al. | 250/370.09 |
| 4,234,794 | A * | 11/1980 | Voinea et al. | 378/12 |
| 4,686,695 | A * | 8/1987 | Macovski | 378/146 |
| 6,272,206 | B1 * | 8/2001 | Bjorkholm | 378/146 |
| 6,570,960 | B1 * | 5/2003 | Kuzniar et al. | 378/125 |
| 6,873,683 | B2 * | 3/2005 | Tiwari et al. | 378/131 |
| 7,184,514 | B2 * | 2/2007 | Kudo | 378/16 |
| 7,224,772 | B2 | 5/2007 | Jacobs et al. | |
| 7,248,674 | B2 * | 7/2007 | Groh et al. | 378/147 |

(Continued)

FOREIGN PATENT DOCUMENTS

DE 10021716 A1 8/2001

(Continued)

OTHER PUBLICATIONS

Shedlock et al., "Optimization of a RSD X-Ray Backscatter System for Detecting Defects in the Space Shuttle External Tank Thermal Foam Insulation", Penetrating Radiation Systems and Applications VII, Edited by Doty, F. Patrick; Barber, H. Bradford; Roehrig, Hans., Proceedings of the SPIE, vol. 5923, 2005, pp. 205-216.

(Continued)

*Primary Examiner*—Edward J Glick
*Assistant Examiner*—Thomas R Artman
(74) *Attorney, Agent, or Firm*—Yee & Associates, P.C.; Clifford G. Cousins

(57) ABSTRACT

A method and apparatus for an x-ray apparatus. The x-ray apparatus comprises a vacuum tube. A cathode is located in the vacuum tube and capable of emitting electrons. A rotatable magnetic anode located in the vacuum tube, capable of being rotated by a motor located outside of the vacuum tube, and capable of generating an x-ray beam in response to receiving the electrons emitted by the cathode.

20 Claims, 6 Drawing Sheets

U.S. PATENT DOCUMENTS

| | | | | |
|---|---|---|---|---|
| 7,286,645 | B2 * | 10/2007 | Freudenberger et al. | 378/146 |
| 7,529,343 | B2 * | 5/2009 | Safai et al. | 378/125 |
| 2007/0189454 | A1 | 8/2007 | Georgeson | |

FOREIGN PATENT DOCUMENTS

| | | | |
|---|---|---|---|
| WO | 2005008716 | A | 1/2005 |

OTHER PUBLICATIONS

U.S. Appl. No. 11/739,835, filed Apr. 25, 2007, Safai.

U.S. Appl. No. 11/744,115, filed May 3, 2007, Safai.

U.S. Appl. No. 11/818,876, filed Jun. 15, 2007, Safai.

* cited by examiner

METHOD AND APPARATUS FOR ROTATING AN ANODE IN AN X-RAY SYSTEM

BACKGROUND INFORMATION

1. Field

The present disclosure relates generally to imaging systems and in particular to a method and apparatus for wide area x-ray imaging. Still more particularly, the present disclosure relates to a method and apparatus for rotating an anode in a wide area x-ray imaging system.

2. Background

An x-ray machine or system uses electromagnetic radiation to produce an image of an object. This type of image is usually produced to visualize something below the surface of the object. An x-ray system may include an x-ray source, an x-ray detection system, and positioning hardware to align these components. The x-ray tube is often times a vacuum tube that produces x-rays on demand. Within an x-ray tube, an emitter in the form of a filament or cathode is present that emits electrons into the vacuum tube. An anode also is present in the tube to collect the electrons and establish a flow of electric current known as a beam through the tube. When electrons from the cathode collide with the anode, energy may be emitted or radiated perpendicularly to the path of the electron beam as x-ray beams.

Vacuum tubes including rotating anodes have been extensively used as x-ray tubes in which the anode includes a rotating x-ray emitting track bombarded by electrons from a cathode. The anode is rotated such that only a small portion of the anode is bombarded by the electrons at any time. As a result, the electrons may distribute over a relatively large surface area. Currently, the use of a rotating anode has been performed to prevent the anode from overheating.

The current x-ray systems use rotating anodes to provide a stationery beam over a large area that rotates to reduce cooling needs. Most current uses for x-rays actually produce x-rays for a small amount of time.

SUMMARY

The advantageous embodiments provide a method and apparatus for an x-ray apparatus. The x-ray apparatus comprises a vacuum tube. A cathode is located in the vacuum tube and capable of emitting electrons. A rotatable magnetic anode is located in the vacuum tube, capable of being rotated by a motor located outside of the vacuum tube, and capable of generating an x-ray beam in response to receiving the electrons emitted by the cathode.

In another advantageous embodiment, a method for operating an x-ray apparatus comprises a vacuum tube having a cathode located in the vacuum tube and capable of emitting electrons, a rotatable magnetic anode located in the vacuum tube capable of being rotated by a motor located outside of the vacuum tube, and capable of generating an x-ray beam in response to receiving the electrons emitted by the cathode. A magnetic field is changed with a motor located outside of the vacuum tube to rotate the rotatable magnetic anode between a first position in which the rotatable magnetic anode directs an x-ray beam at a first location on an object to a second position in which the rotatable magnetic anode directs the x-ray beam at a second location on the object.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

Figure 1:
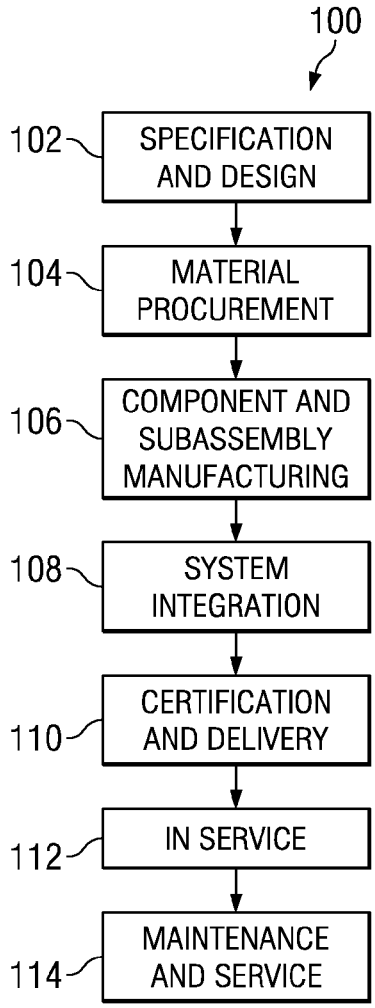
FIG. 1 is a flow diagram of aircraft production and service methodology in which an advantageous embodiment may be implemented.
Figure 2:
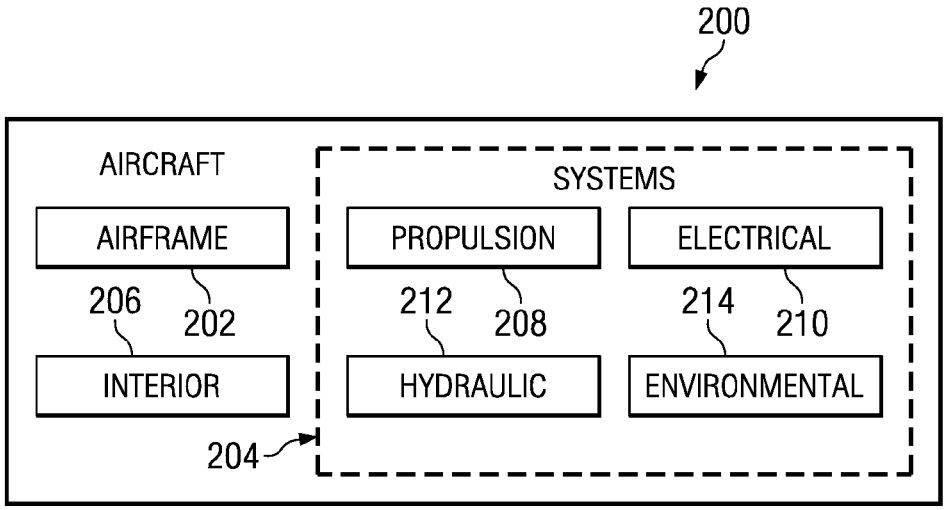
FIG. 2 is a block diagram of an aircraft in accordance with an advantageous embodiment.

Referring more particularly to the drawings, embodiments of the disclosure may be described in the context of aircraft manufacturing and service method 100 as shown in FIG. 1 and aircraft 200 as shown in FIG. 2. Turning first to FIG. 1, a diagram illustrating an aircraft manufacturing and service method is depicted in accordance with an advantageous embodiment. During pre-production, exemplary aircraft manufacturing and service method 100 may include specification and design 102 of aircraft 200 in FIG. 2 and material procurement 104. During production, component and subassembly manufacturing 106 and system integration 108 of aircraft 200 in FIG. 2 takes place. Thereafter, aircraft 200 in FIG. 2 may go through certification and delivery 110 in order to be placed in service 112. While in service by a customer, aircraft 200 in FIG. 2 is scheduled for routine maintenance and service 114, which may include modification, reconfiguration, refurbishment, and other maintenance or service.

Each of the processes of aircraft manufacturing and service method 100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of venders, subcontractors, and suppliers; and an operator may be an airline, leasing company, military entity, service organization, and so on.

With reference now to FIG. 2, a diagram of an aircraft is depicted in which an advantageous embodiment may be implemented. In this example, aircraft 200 is produced by aircraft manufacturing and service method 100 in FIG. 1 and may include airframe 202 with a plurality of systems 204 and interior 206. Examples of systems 204 include one or more of propulsion system 208, electrical system 210, hydraulic system 212, and environmental system 214. Any number of other systems may be included. Although an aerospace example is shown, different advantageous embodiments may be applied to other industries, such as the automotive industry.

Apparatus and methods embodied herein may be employed during any one or more of the stages of aircraft manufacturing and service method 100 in FIG. 1. For example, components or subassemblies produced in component and subassembly manufacturing 106 in FIG. 1 may be fabricated or manufactured in a manner similar to components or subassemblies produced while aircraft 200 is in service 112 in FIG. 1. Also, one or more apparatus embodiments, method embodiments, or a combination thereof may be utilized during production stages, such as component and subassembly manufacturing 106 and system integration 108 in FIG. 1, for example, without limitation, by substantially expediting the assembly of or reducing the cost of aircraft 200. Similarly, one or more of apparatus embodiments, method embodiments, or a combination thereof may be utilized while aircraft 200 is in service 112 or during maintenance and service 114 in FIG. 1.

The different advantageous embodiments recognize that the use of x-ray systems for identifying the geometry of hidden objects and structures, such as an aircraft, may be useful. The different advantageous embodiments recognize that currently used x-ray systems point an x-ray beam at one particular location on a target. Thus, the use of these types of x-ray systems in imaging aircraft has not been widely used. Further, the different advantageous embodiments recognize that maintaining low power requirements also has not been of interest with conventional uses, such as medical uses of x-ray systems.

The advantageous embodiments recognize that it would be desirable for increasing the field of view of an x-ray imaging system while maintaining low power requirements. Further, the different advantageous embodiments recognize that with longer continuous uses of x-ray systems for imaging a large object, such as an aircraft, higher reliability is desirable for these types of uses. In particular, the different advantageous embodiments recognize that the current use of rotating anodes with motors incorporated within the vacuum tube may lead to increased reliability problems that previously were not of concern.

Thus, the different advantageous embodiments provide a method and apparatus for wide area x-ray imaging in which a rotating anode may be used with a motor that is located externally to the vacuum tube. A rotatable anode, in these examples, is an anode that can turn or move around an axis or center. The movement may be, for example, a complete rotation in which movement is back and forth, such as an oscillation, or any other suitable movement.

Figure 3:
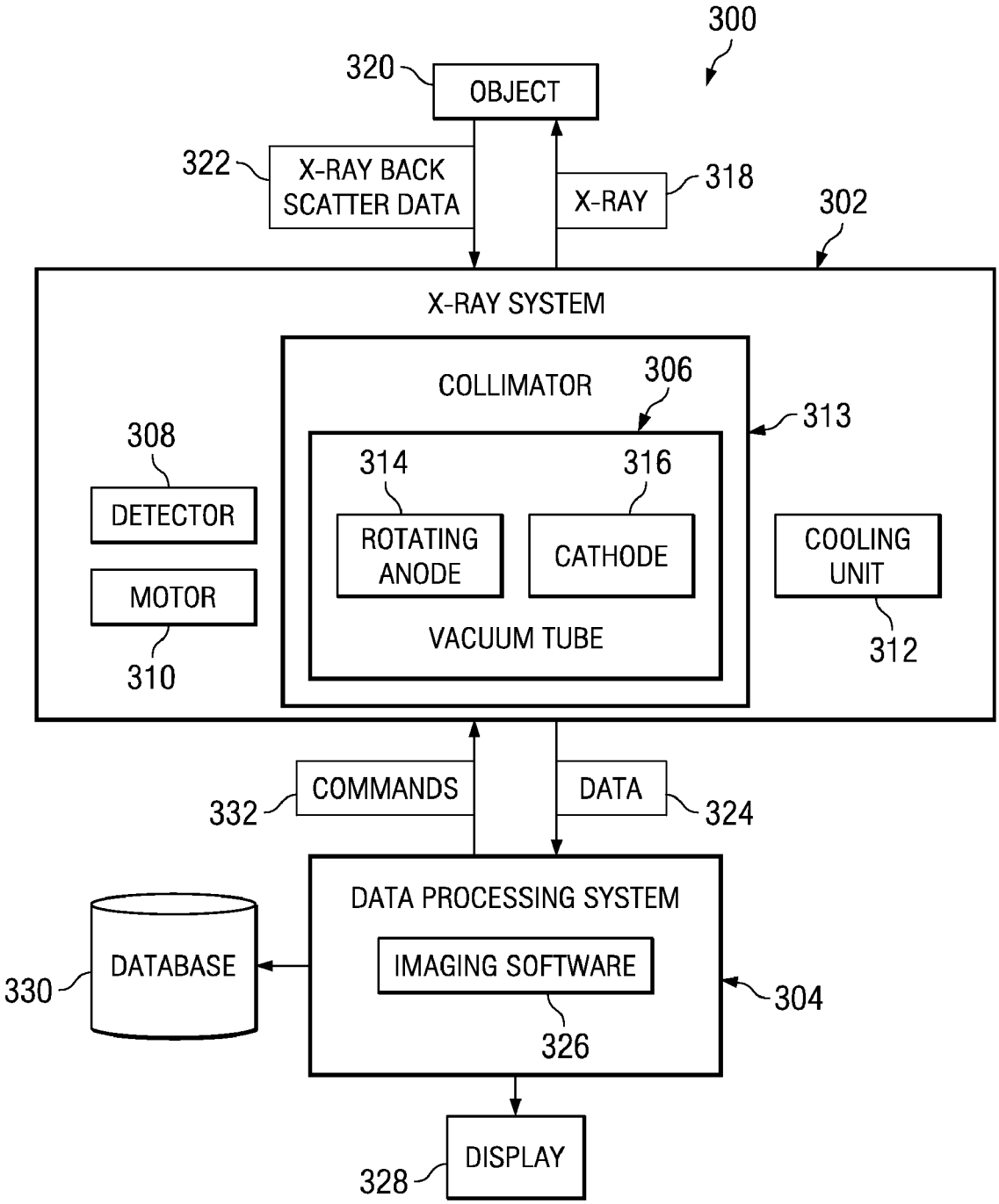
FIG. 3 is a diagram of an imaging system in accordance with an advantageous embodiment.

With reference now to FIG. 3, a diagram of an imaging system is depicted in accordance with an advantageous embodiment. In this example, imaging system 300 includes x-ray system 302 and data processing system 304. x-ray system 302 includes vacuum tube 306, detector 308, motor 310, cooling unit 312, and collimator 313. Vacuum tube 306 includes rotatable anode 314 and cathode 316. In these examples, rotatable anode 314 is a rotatable magnetic anode that may be moved in a number of different ways, such as, for example, without limitation, rotate, oscillate, or any other suitable type of movement.

A rotatable magnetic anode is a rotatable anode that has magnetic properties or characteristics. The properties are ones that may allow the magnetic anode to be moved. The anode it self may incorporate magnetic materials or magnets. In other examples, magnets may be attached to the anode. The magnets may be for example a ceramic or metal type magnet. In this example, cathode 316 and rotatable anode 314 generate x-ray 318, which is directed towards object 320.

A portion of the x-ray energy may be sent out through x-ray system 302 through collimator 313. Collimator 313 may include aperture to allow a portion of the x-ray energy generated by rotatable anode 314 to be directed towards object 320, in these examples. Collimator 313 may rotate to change the direction of which x-ray energy may be emitted from x-ray system 302. In these examples, object 320 may be, for example, an aircraft, a spacecraft, a car, a truck, a building, or some other object for which geometric data below the surface of object 320 is desired. A response, in the form of x-ray back scatter data 322, is received by x-ray system 302 through detector 308.

In these examples, motor 310 is located external to vacuum tube 306 in contrast to presently used configurations for rotating anodes in x-ray systems. In these examples, motor 310 may be, for example, an electric motor generating a magnetic field causing rotatable anode 314 to rotate. Motor 310 may take various forms. For example, motor 310 may be, for example, without limitation, a set of coils that generate the magnetic field. In another advantageous embodiment, motor 310 may be an electric motor with a configuration of magnets mounted on a shaft that may rotate to cause rotatable anode 314 to rotate.

Further, x-ray system 302, in these examples, also includes cooling unit 312. Cooling unit 312 is present, in these examples, to provide cooling for vacuum tube 306. This type of cooling is provided because of the type of use for x-ray system 302.

In the different advantageous embodiments, object 320 is a large object as compared to objects typically x-rayed using integrated systems. As a result, x-ray system 302 may be required to be used for much longer periods of time as compared to conventional x-ray systems used for medical imaging. Cooling unit 312 may be, for example, an air, water, or oil cooling system. Cooling unit 312 may include coils or tubes that are located near the filament in the cathode and near the anode.

X-ray system 302 may send data 324 to data processing system 304 with processing performed by imaging software 326. Data 324 may be x-ray back scatter data 322 as received from object 320. In some advantageous embodiments, data 324 may be processed by x-ray system 302. For example, filtering or other types of image processing may be initially performed by x-ray system 302 to generate data 324.

In these examples, imaging software 326 may include a set of one or more types of software. For example, two dimensional software may be used to generate two dimensional images of surfaces of object 320. Further, the two dimensional images also may be stitched or combined using two dimensional panoramic image creation software to create a more complete panoramic image of object 320. Additionally, imaging software also may include three dimensional software to convert the images from a two dimensional form to a three dimensional model. This type of information may be displayed on display 328 or stored in database 330 for later use.

Imaging software 326 may be implemented using various commercially available programs. For example, Catia V5R17 is an example of a three dimensional modeling program that may be used to generate both three dimensional and two dimensional images from data 324. Catia V5R17 is available from Dassault Systemes. Of course, other types of software may be used in addition to or in place of Catia V5R17.

Further, imaging software 326 may generate commands 332 to control the transmission of x-ray 318 and the collection of x-ray back scatter data 322. In addition, in some advantageous embodiments, x-ray system 302 may be a mobile or moveable x-ray system. With this type of system, imaging software 326 also may send commands 332 to move x-ray system 302 in a manner to collect the data needed from object 320 to generate models of object 320.

Figure 4:
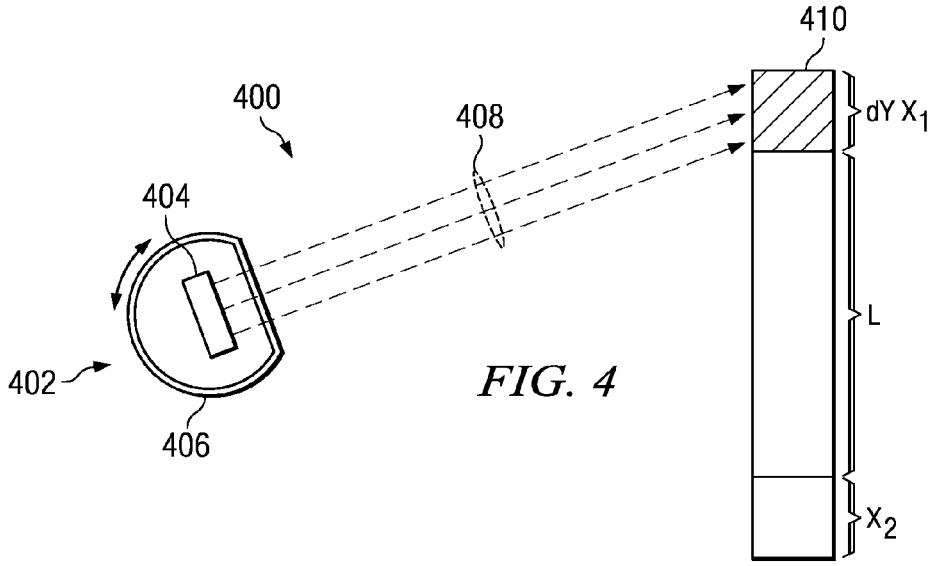
FIGS. 4, 5, and 6 are simplified schematic top views of an x-ray imaging system in accordance with an advantageous embodiment.
Figure 5:
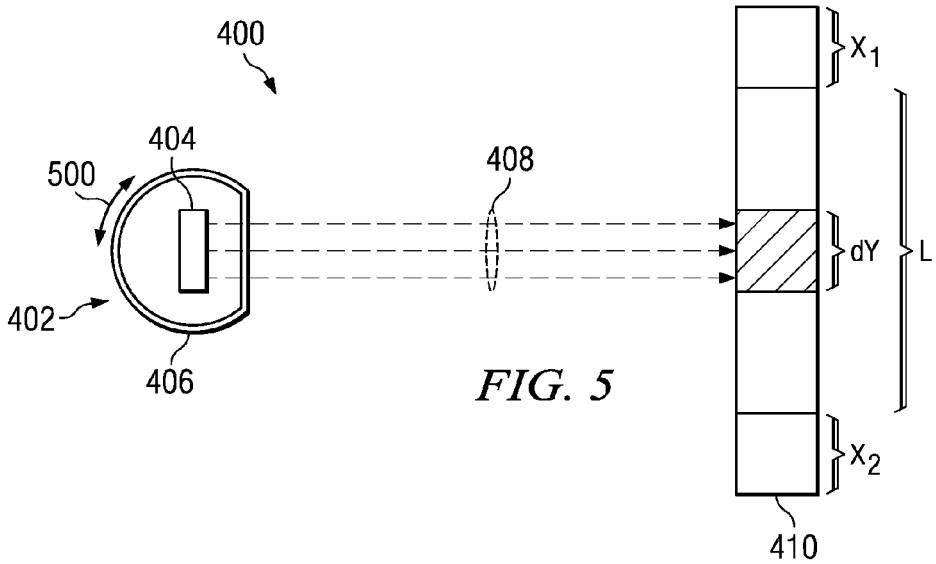
Figure 6:
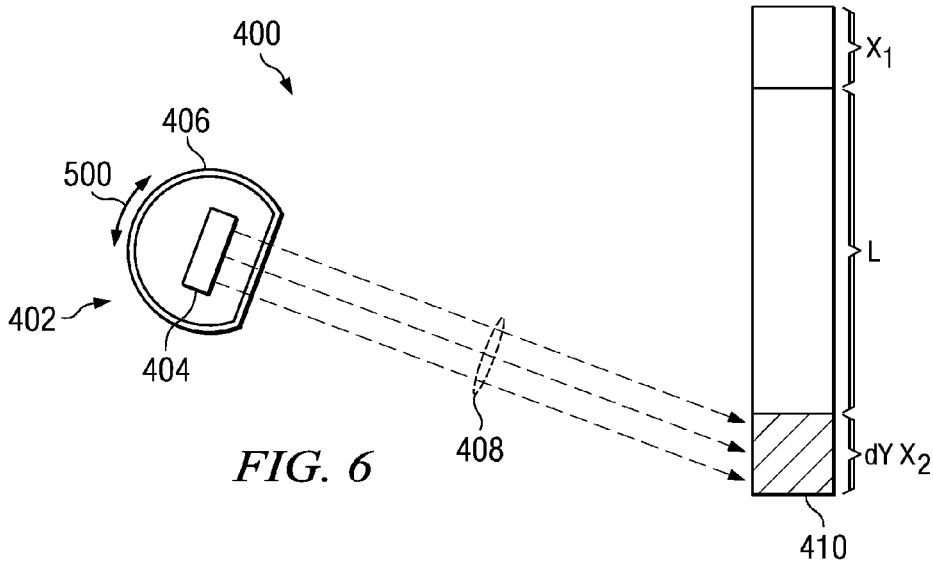
Figure 7:
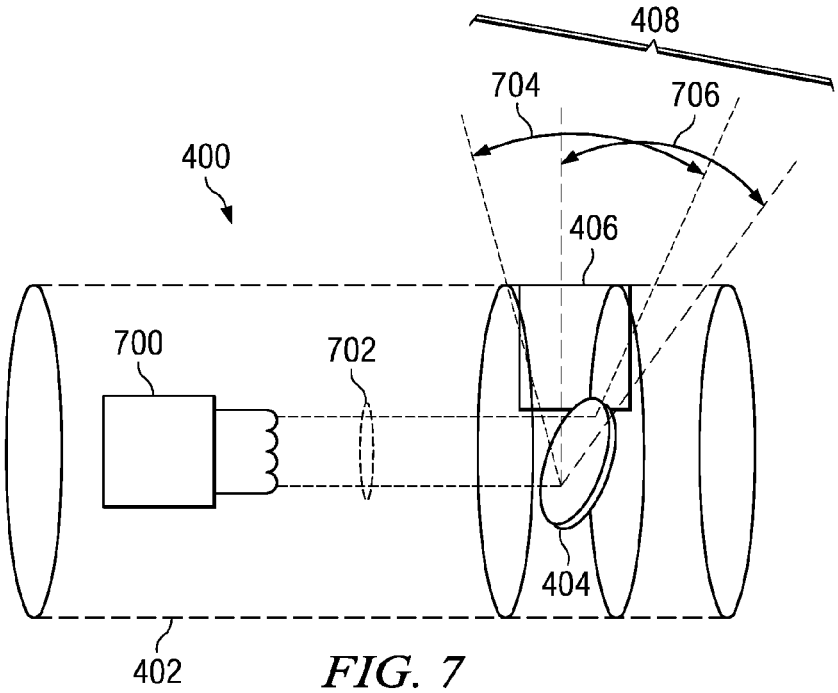
FIG. 7 is a simplified side view of an x-ray imaging system in accordance with an advantageous embodiment.

FIGS. 4, 5, and 6 are simplified schematic top views and FIG. 7 is a simplified side view of x-ray imaging system 400 in accordance with an embodiment of the disclosure. X-ray imaging system 400 includes x-ray tube 402 having rotating anode 404, cathode 316 in FIG. 3, and continuous window 406, which allows for up to a 360 degree emission of x-ray beam 408 for a wider area of imaging.

In operation, cathode 316 emits electrons into the vacuum of x-ray tube 402. Rotating anode 404 collects the electrons to establish a flow of electrical current through x-ray tube 402. Rotating anode 404 generates x-ray beam 408 that emits through window 406 in x-ray tube 402 to create an image of object 410 under examination.

In this embodiment, rotating anode 404, is an anode that moves within x-ray tube 402, such that x-ray beam 408 is made to scan across object 410. X-ray beam 408 may generate a "fan shape" as x-ray beam 408 sweeps downward from position $X_1$ to position $X_2$.

For example, referring to FIG. 4, in operation, rotating anode 404 may be pointed in a first direction, such as toward top portion $X_1$. While pointed at position $X_1$, x-ray beam 408 covers a portion dY of object 410, which is proportional to the width of x-ray beam 408.

As shown in FIG. 5, rotating anode 404 may then be rotated as indicated by arrow 500 causing x-ray beam 408 to continuously move across an incremental portion dY across the entire length of object 410.

As shown in FIG. 6, rotating anode 404 may continue to rotate until x-ray beam 408 is pointed in a second direction, such as toward bottom portion $X_2$ of object 410, covering the incremental portion dY. In this manner, x-ray beam 408 is made to image the entire length ($X_1$+$X_2$+L) at increments dY. The rate of rotation of rotating anode 404 may be set to any desired rate which provides adequate x-ray flux imaging for an intended purpose. In one embodiment, the rate of rotation of rotating anode 404 may range from about 5 revs/sec to about 25 revs/sec. Rotating anode 404 may be made to rotate or otherwise move to provide a non-stationary beam using any motor of the x-ray tube. The change in the dY portion of the emission of x-ray beam 408 may be caused by a rotating collimator, such as collimator 313 in FIG. 3.

In another embodiment, an x-ray back scatter system is provided which includes an x-ray tube (vacuum tube) that generates photons, and at least one silicon-based detector or photo-multiplier tube. Generally, photons emerge from the source or anode in a collimated "flying spot" beam that scans vertically. Back scattered photons are collected in the detector (s) and used to generate two-dimensional or three-dimensional images of objects. The angle over which the spot travels is limited by the x-ray fan angle coming off the anode.

With reference now to FIG. 7, a diagram of a simplified side view of x-ray imaging system 400 is depicted. In this view, cathode 700 may be visible and generates electron beam 702, which is directed at rotating anode 404. In response, electron beam 702 may be generated and may sweep across arc 704 and arc 706 as rotating anode 404 rotates. Arc 704 and arc 706 represents a rotation of window 406. Arc 704 and arc 706 generate a "fan" shape for x-ray beam 408.

Figure 8:
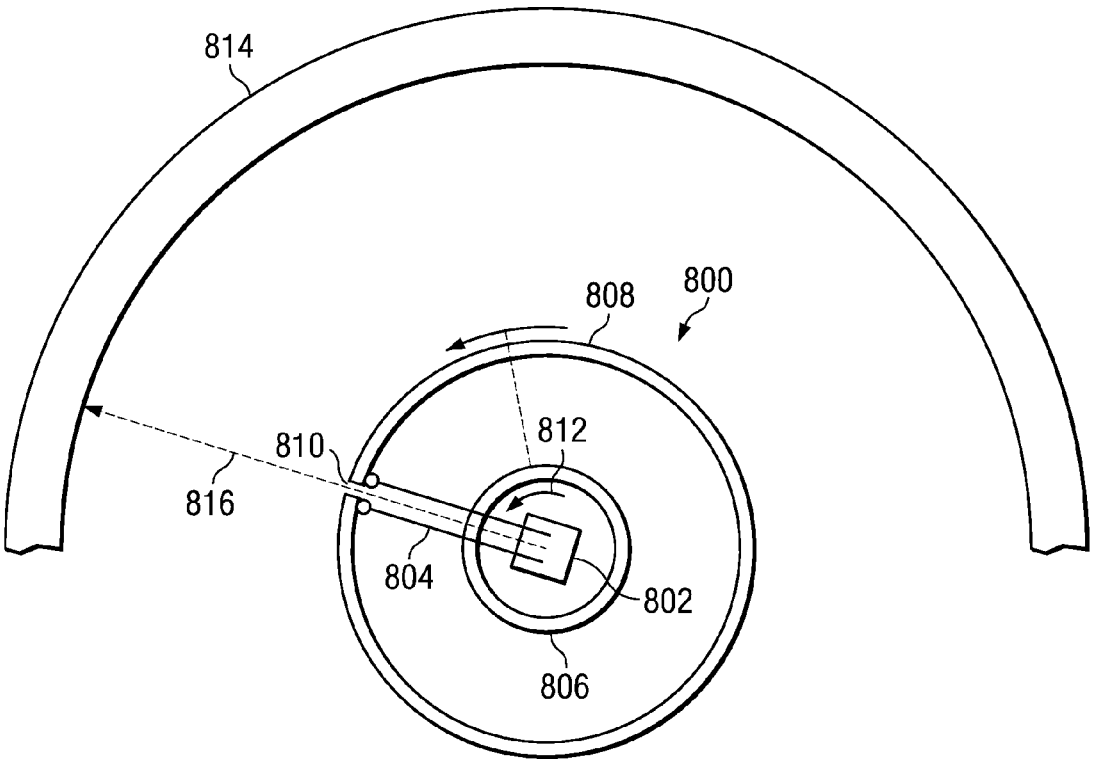
FIG. 8 is a simplified illustration of an operational embodiment of an x-ray system in accordance with an advantageous embodiment.

FIG. 8 is a simplified illustration of an operational embodiment of x-ray system 800, including rotating anode 802, which can be made to rotate within the x-ray tube, for example, in the direction of arrow 812. X-ray system 800 also includes continuous window 806, and rotating collimator 808 having aperture 810, which surrounds rotating anode 802. Generally, x-ray beam 804 is directed through aperture 810 to impinge on object 814 as rotating collimator 808 rotates around rotating anode 802. In these examples, rotating anode 802 rotates to generate an arc or "fan shape" in x-ray beam 804. The x-rays back scattered from object 814 are picked up by a photo multiplier tube or solid state detector (not shown), which generates electric signals that can be used to produce an image.

In one operational embodiment, the relative rotation of rotating anode 802 and of rotating collimator 808 is linked. Accordingly, in this embodiment, aperture 810 can be made to rotate in constant alignment with rotating anode 802. By linking the relative rotation of rotating anode 802 and rotating collimator 808, x-ray beam 804 may be directed specifically at aperture 810 during the entire imaging operation. Because x-ray beam 804 is concentrated directly in the vicinity of aperture 810 during the entire imaging operation, the concentration 816 of x-ray beam 804, which actually passes through aperture 810, represents a large percentage of the actual beam of x-ray beam 804.

Thus, the efficiency associated with using a more concentrated beam, such as x-ray beam 804, continuously directed at aperture 810 as rotating collimator 808 and rotating anode 802 rotate, allows for the use of a smaller anode with a less powerful beam. In turn, the smaller anode allows the dimensions of the x-ray tube to also be reduced, because of the lower size and power requirements.

Directing x-ray beam 804 continuously at aperture 810 during an imaging operation also allows for complete circumferential beam coverage to cover a larger area of inspection with a larger field of view. Alternatively, x-ray beam 804 may be made to obtain a more concentrated x-ray at a particular location.

Although the system and method of the present disclosure are described with reference to a flying spot x-ray system (back scatter and transmission), those skilled in the art will recognize that the principles and teachings described herein may also be applied to conventional transmission x-ray systems and x-ray tomography systems.

Figure 9:
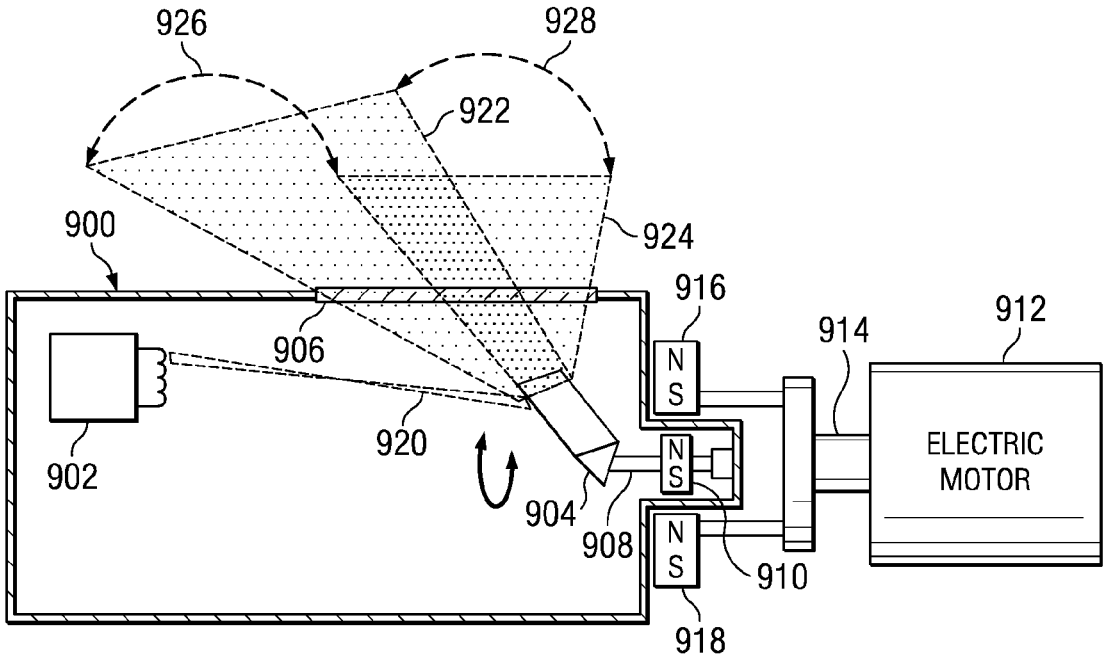
FIG. 9 is a diagram of an oscillating anode with an external motor in accordance with an advantageous embodiment.

With reference now to FIG. 9, a diagram of an oscillating anode with an external motor is depicted in accordance with an advantageous embodiment. In this example, vacuum tube 900 includes cathode 902, rotating magnetic anode 904, and x-ray window 906. Rotating magnetic anode 904 is mounted on rotatable member 908, which may be, for example, without limitation, a rotating shaft. Additionally, rotatable member 908 includes magnet 910. On the exterior of vacuum tube 900 is electric motor 912. Electric motor 912 is an example of a motor that may be used to implement motor 310 in FIG. 3. Electric motor 912 has rotating shaft 914. Magnets 916 and 918 are mounted on rotating shaft 914.

Electric motor 912 may move magnets 916 and 918 in a manner that causes rotating magnetic anode 904 to oscillate within vacuum tube 900, in these examples. As cathode 902 emits electrons 920, x-rays 922 and 924 are generated in the manner illustrated with a wide angle. In this example, rotating magnetic anode 904 is an elongate member in the shape of a triangle. Each side of rotating magnetic anode 904 may produce a different angle of incidents of x-rays generated and transmitted through x-ray window 906. By rotating or moving rotating magnetic anode 904, the location of electron bombardment by cathode 902 from electrons 920 results in x-ray generation distributed through x-ray window 906 to form x-rays 922 and 924 that may move along a path as shown by dotted lines 926 and 928.

Figure 10:
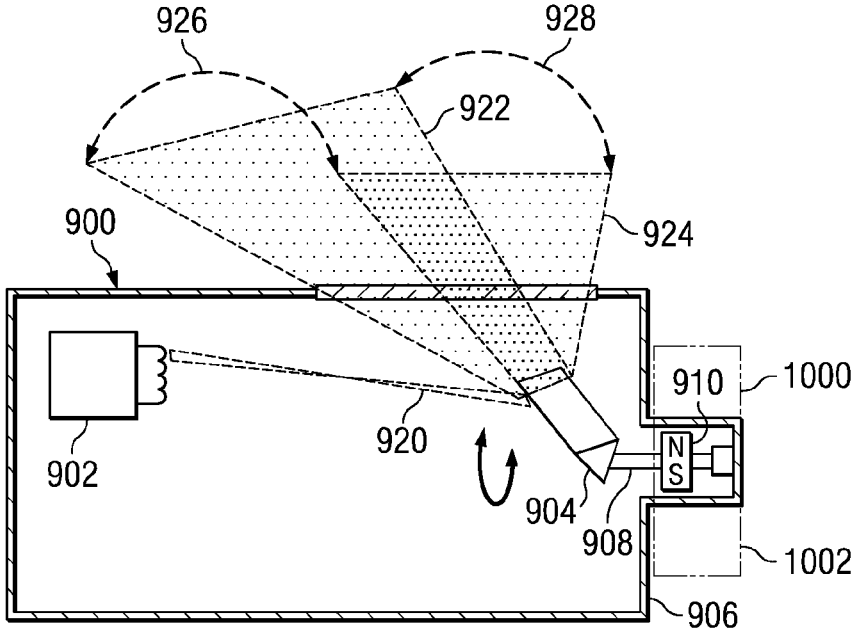
FIG. 10 is a diagram illustrating an oscillating anode with an electromagnetic coil mechanism in accordance with an advantageous embodiment.

With reference now to FIG. 10, a diagram illustrating an oscillating anode with an electromagnetic coil mechanism is depicted in accordance with an advantageous embodiment. In this example, rotating magnetic anode 904 rotates and/or oscillates in response to electric fields generated by electromagnetic coil 1000. Electromagnetic coil 1000, in these examples, is an example of one implementation for motor 310 in FIG. 3. Electromagnetic coil 1000 contains coils 1002 through which current may be applied in a fashion to generate an electromagnetic field. The electromagnetic field may be controlled in a manner to cause rotating magnetic anode 904 to rotate and/or oscillate.

Figure 11:
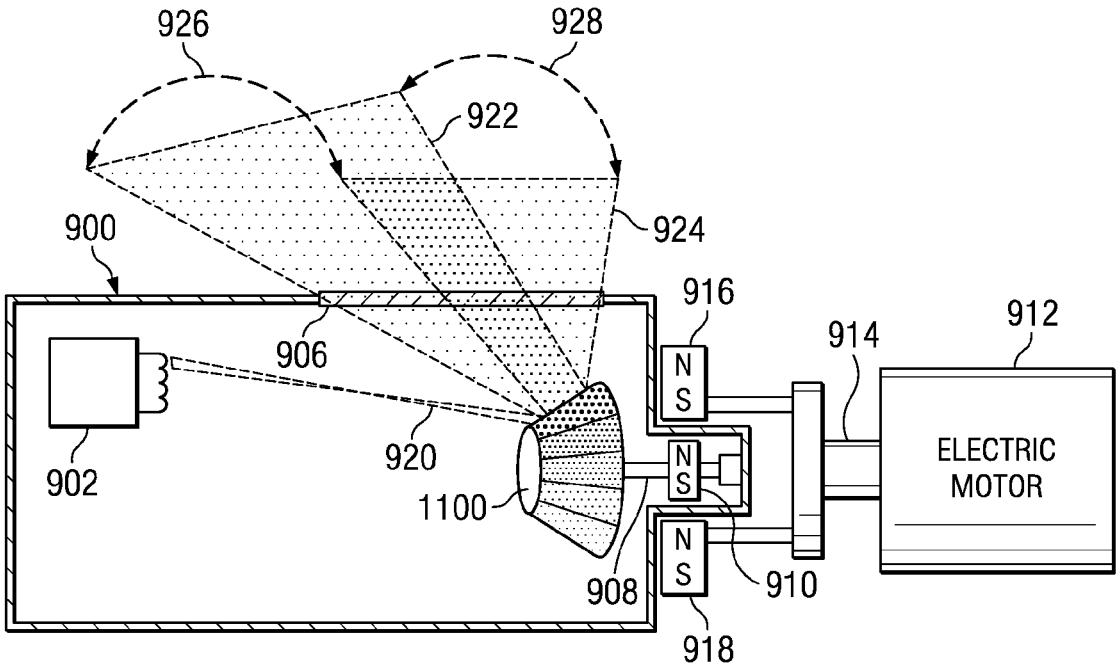
FIG. 11 is a diagram of a rotating anode with an external magnetic driven oscillation mechanism in accordance with an advantageous embodiment.

Turning next to FIG. 11, a diagram of a rotating anode with an external magnetic driven oscillation mechanism is depicted in accordance with an advantageous embodiment. In this example, vacuum tube 900 contains rotating anode 1100, which may be rotated using electric motor 912. Rotating anode 1100, in this example, takes the form of a different polygonal shape.

Figure 12:
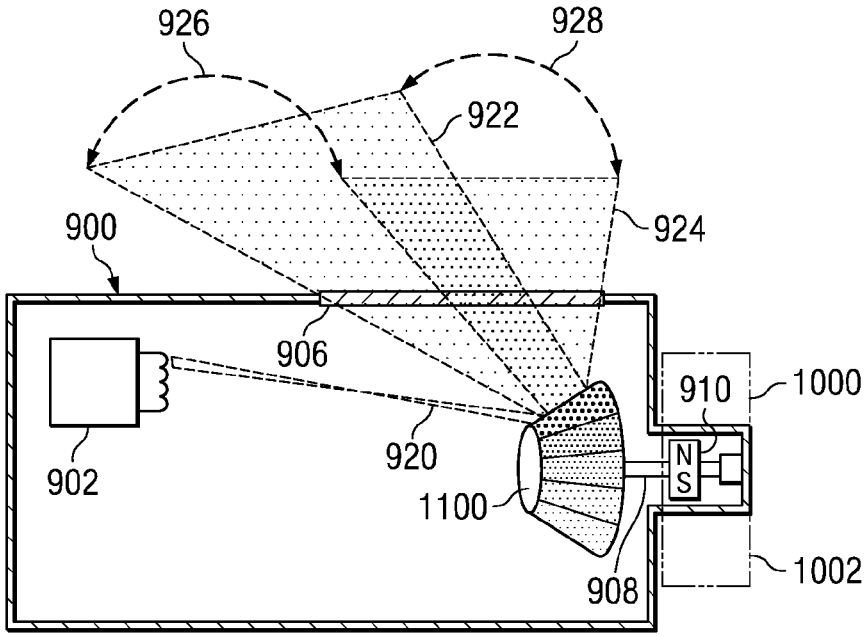
FIG. 12 is a diagram of a rotating anode with an external electromagnetic coil in accordance with an advantageous embodiment.

Turning now to FIG. 12, a diagram of a rotating anode with an external electromagnetic coil is depicted in accordance with an advantageous embodiment.

In some examples, a rotatable magnetic anode is depicted in which the rotatable magnetic anode is moved in a number of different ways. In some examples, the rotatable magnetic anode is rotated and in other examples the rotatable magnetic anode is oscillated. The different advantageous embodiments may utilize any type of movement of a rotatable magnetic anode with a motor that is located outside of the vacuum tube. Also, the different advantageous embodiments are discussed with respect to a rotatable anode that is a rotatable magnetic anode in which movement of the rotatable magnetic anode is caused by a magnetic field generated by a motor outside of the vacuum tube. The different advantageous embodiments may utilize any type of anode that is moveable by a motor located outside of the vacuum tube.

Thus, the different advantageous embodiments provide a method and apparatus for an x-ray system. In one advantageous embodiment, an x-ray apparatus may include a vacuum tube, a cathode, and a rotatable magnetic anode. The cathode is located in the vacuum tube and capable of moving electrons. The rotatable magnetic anode also is located in the vacuum tube and is capable of being rotated by a motor located outside of the vacuum tube. Further, the rotatable magnetic anode is capable of generating an x-ray beam in response to receiving the electrons emitted by the cathode. In these examples, the rotatable magnetic anode may include an anode, a rotatable shaft connected to the anode and a magnetic element connected to the rotatable shaft capable of causing the rotatable shaft to rotate in response to a field generated by the motor.

In this manner, the different advantageous embodiments reduce the complexity of the components located within the vacuum tube. One result of the different configurations, in the advantageous embodiments, is reducing the possibility that the vacuum tube may become unusable because of a failure in the motor. Additionally, the different advantageous embodiments also may provide for a reduction in size of the vacuum tube because of the location of the motor outside of the vacuum tube.

Although the different advantageous embodiments have been illustrated with respect to an x-ray apparatus or system in which a non-stationery beam allows for a more uniform and wider inspection area or field of view, the different advantageous embodiments may be applied to all types of x-ray system in which a moveable or rotatable anode may be present.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An x-ray apparatus comprising:

a vacuum tube;

a cathode located in the vacuum tube and capable of emitting electrons;

a rotatable magnetic anode is located in the vacuum tube, is capable of being rotated by a motor located outside of the vacuum tube, and is capable of generating an x-ray beam in response to receiving the electrons emitted by the cathode, wherein rotating the rotatable magnetic anode causes the x-ray beam to be rotated about an axis of rotation of the rotatable magnetic anode; and a detector capable of detecting x-ray back scatter data received from the x-ray beam striking an object.

2. The x-ray apparatus of claim 1, wherein the rotatable magnetic anode comprises:

an anode;

a rotatable shaft connected to the anode; and a magnetic element connected to the rotatable shaft capable of causing the rotatable shaft to rotate in response to a field generated by the motor.

3. The x-ray apparatus of claim 1 further comprising:

the motor.

4. The x-ray apparatus of claim 3, wherein the motor comprises:

a motor unit;

a rotatable shaft connected to the motor unit; and a magnetic unit mounted on the rotatable shaft, the magnetic unit capable of causing the rotatable magnetic anode to move around an axis.

5. The x-ray apparatus of claim 3, wherein the motor comprises:

a plurality of magnetic coils positioned with respect to the vacuum tube to be capable of causing the rotatable magnetic anode to move around an axis.

6. The x-ray apparatus of claim 1, wherein the x-ray beam is non-stationary.

7. The x-ray apparatus of claim 3 further comprising:

a cooling unit capable of cooling the vacuum tube during operation of the x-ray apparatus.

8. The x-ray apparatus of claim 7 further comprising:

a processor for processing the x-ray back scatter data to create an image of the object.

9. The x-ray apparatus of claim 1, wherein the rotatable magnetic anode oscillates to generate a non-stationary beam.

10. The x-ray apparatus of claim 1, wherein the rotatable magnetic anode has a polyhedronal shape.

11. The x-ray apparatus of claim 1 further comprising:

a collimator having an aperture capable of allowing a portion of the x-ray beam to be emitted, wherein the vacuum tube is surrounded by the collimator and wherein the collimator is capable of being rotated in relation to the rotation of the rotatable magnetic anode.

12. The x-ray apparatus of claim 1 further comprising:

a continuous circumferential window located in the vacuum tube that allows for up to a 360 degree emission of the x-ray beam.

13. A method for operating an x-ray apparatus comprising:

providing a vacuum tube having a cathode and a rotatable magnetic anode located in the vacuum tube, the cathode capable of emitting electrons and the rotatable magnetic anode capable of being rotated by a motor located outside of the vacuum tube and capable of generating an x-ray beam in response to receiving the electrons emitted by the cathode;

changing a magnetic field with a motor located outside of the vacuum tube to rotate the rotatable magnetic anode between a first position in which the rotatable magnetic anode directs an x-ray beam at a first location on an object to a second position in which the rotatable magnetic anode directs the x-ray beam at a second location on the object, wherein rotating the rotatable magnetic anode causes the x-ray beam to be rotated about an axis of rotation of the rotatable magnetic anode; and detecting, by a detector, x-ray back scatter data received from the x-ray beam striking an object.

14. The method of claim 13 further comprising:

rotating a collimator with an aperture around the vacuum tube to allow a portion of the x-ray beam to be emitted through the aperture.

15. The method of claim 13, wherein the rotatable magnetic anode comprises:

an anode;

a rotatable shaft connected to the anode; and a magnetic element connected to the rotatable shaft capable of causing the rotatable shaft to rotate in response to a field generated by the motor.

16. The method of claim 13, wherein the motor comprises:

a motor unit;

a rotatable shaft connected to the motor unit; and a magnetic unit mounted on the rotatable shaft, the magnetic unit capable of causing the rotatable magnetic anode to move around an axis.

17. The method of claim 13, wherein the motor comprises:

a plurality of magnetic coils positioned with respect to the vacuum tube to be capable of causing the rotatable magnetic anode to move around an axis.

18. The method of claim 13, wherein the rotatable magnetic anode has a polyhedronal shape.

19. The method of claim 13 further comprising:

providing a continuous circumferential window that allows for up to a 360 degree emission of the x-ray beam; and processing the response with a data processing system to create an image of the object.

20. The method of claim 19, wherein the response is back scatter x-ray data.

* * * * *